United States Patent [19]

Sharp

[11] Patent Number: 4,676,420

[45] Date of Patent: Jun. 30, 1987

[54] ATTACHMENT DEVICE

[76] Inventor: Graham D. F. Sharp, Sportsmans End, West Malling, Kent, England

[21] Appl. No.: 841,211

[22] Filed: Mar. 19, 1986

[30] Foreign Application Priority Data

Mar. 22, 1985 [GB] United Kingdom ..... 8507529

[51] Int. Cl.[4] ..... A45F 5/00

[52] U.S. Cl. ..... 224/271; 224/197; 224/272; 24/590; 24/663

[58] Field of Search ..... 224/914, 904, 196, 197, 224/200, 199, 224, 233, 242, 249, 252, 269, 271, 272; 221/272, 273; 24/590, 663, 666, 667, 701

[56] References Cited

U.S. PATENT DOCUMENTS

| | | | |
|---|---|---|---|
| 3,743,147 | 7/1973 | Wilczynski | 224/199 |
| 4,083,481 | 4/1978 | Selinko | 224/252 |
| 4,485,946 | 12/1984 | Liautaud | 224/242 |

*Primary Examiner*—Stephen Marcus

*Assistant Examiner*—David Voorhees

*Attorney, Agent, or Firm*—Roylance, Abrams, Berdo & Goodman

[57] ABSTRACT

An attachment device for enabling an article to releasably be secured on a person has a stud, a plate member and co-operating portions on the stud and the plate member. The stud includes a part circular flange with a flat portion along its periphery. The plate member includes a lead-in channel extending from an edge of the plate member towards an opposite edge of the plate member, a part-circular reception portion extending from the channel, and a tongued portion extending from the reception portion in the direction of the reception portion but spaced apart from the reception portion. The stud and the plate member are engageable and dis-engageable by a sliding action. The co-operating portions allow the stud and plate member to rotate and to be held together until they are subjected to a disengaging sliding action exceeding a predetermine value.

7 Claims, 10 Drawing Figures

ATTACHMENT DEVICE

BACKGROUND OF THE INVENTION

This invention relates to an attachment device for enabling an article to releaseably be secured on a person.

It frequently happens that a person needs to releaseably secure an article to his or her body. For example, police and military personnel often need to secure about their person a radio transceiver, workmen often need to secure about their person tools such as hammers and screwdrivers, firemen often need to secure about their person axes and torches and often people like to secure bunches of keys about their person so that the keys are available for various purposes. There is currently no universal attachment device that can enable a very wide variety of articles to releaseably be secured on a person. Attachment devices do exist but they are usually custom made for a particular model of article and different models of the same general type of article often cannot use the same attachment device. Furthermore, many of the known types of attachment device do not sufficiently secure the article to the person, or they secure the article to the person so completely that disengagement is not easily accomplished. Furthermore, there is often a problem with many of the attachment devices in that they cause the article to be secured in one position only to the person and, for example, this position may be comfortable for the person whilst the person is standing but may be very uncomfortable for the person whilst the person is sitting.

It is an aim of the present invention to provide an attachment device which obviates or reduces the above mentioned problems.

SUMMARY OF THE INVENTION

Accordingly, this invention provides an attachment device for enabling an article to releasably be secured on a person, which attachment device comprises a stud, a plate member and co-operating portions on said stud and said plate member, said stud including a part circular flange which has a flat portion along its periphery, said plate member including (i) a lead-in channel which extends from an edge of said plate member towards an opposite edge of said plate member;

(ii) a part-circular reception portion which extends from said channel;

(iii) a tongued portion which extends from said reception portion in the direction of said reception portion but spaced apart from said reception portion;

(iv) a first pair of shoulders which connect said reception portion to said channel and which are such that one shoulder is shorter than the other shoulder;

(v) a second pair of shoulders which connect said tongued portion to said channel and which are such that one shoulder is shorter than the other shoulder, said first and said second pairs of shoulders causing said channel to be longitudinally non-symmetrical so that said stud is only able to slide along said channel from said edge of said plate member when said flat portion of said flange is adjacent that shoulder in each said pair of shoulders that is said shortest shoulder, and said attachment device being such that said stud and said plate member are engageable and dis-engageable by a sliding action along said channel when said stud and said plate member are in a first relative position, said attachment device being such that said stud and said plate member are not dis-engageable when said stud and said plate member have been rotated to a second relative position, and said co-operating portions of said stud and said plate member being such as to permit said rotation but also to prevent said stud and said plate member from dis-engaging when they are in said first relative position until said stud and said plate member are subjected to a dis-engaging sliding actin which exceeds a predetermined value.

Preferably, said co-operating portions are a pip on said tongued portion and a complementary depression on said stud.

The attachment device may be one in which said plate member is a metal plate member, in which said tongued portion is cut and pressed out of said plate member to leave behind said reception portion, and in which said channel is pressed out of said plate member.

The attachment device may also be one in which said stud projects from a fixing plate, and in which said stud is fixed in position with respect to said fixing plate.

The said stud and said fixing plate may be rotatable through 180° to go from said first relative position to said second relative position. Obviously, if desired, different angles of relative rotation of said stud and said fixing plate may be employed so that the rotation can be to any desired position, and, if in the said rotated second position, said stud and said fixing plate are not disengageable. Usually, the relative rotation will be effected by moving only said stud, said fixing plate being stationary. The reverse arrangement may of course by employed if desired and both said stud and said fixing plate can be moved together if desired.

Preferably, said plate member includes a pair of side walls, said side walls each being provided with a slot, said slots being for receiving a belt.

Also preferably, said plate member has four holes which are each for receiving a clip, said plate member being four sided and there being one said hole in each corner of said plate member.

The attachment device is advantageously provided with the slots and the holes so that the plate member may be secured where desired in a variety of ways. For example, the slots can receive a belt whilst the holes can receive clips, the clips being attached to webbing. With four holes, one piece of webbing can be attached to two holes whilst another piece of webbing can be attached to the other two holes.

Preferably, the stud is for attachment to the article and the plate member is for attachment to the person. It is to be appreciated however that the reverse arrangement may be employed if desired.

When the stud is for attachment to the article, then the article may be, a radio transceiver, a radio, a tool, a key ring, or any other object that needs to be comfortably worn, secured and unsecured, and safely held. As indicated above, persons such for example as police personnel, firemen, military personnel, and workmen may be amongst those using the attachment device of the invention.

When the plate member is used for connecting to a belt, for example through the above mentioned slots, and/or to straps, for example through the above mentioned holes, then the belt and/or the straps enable the plate member to be secured where desired on a person, for example, around their waist, neck or over one shoulder.

An embodiment of the invention will now be described solely by way of example and with reference to the accompanying drawings in which.

Figure 1:
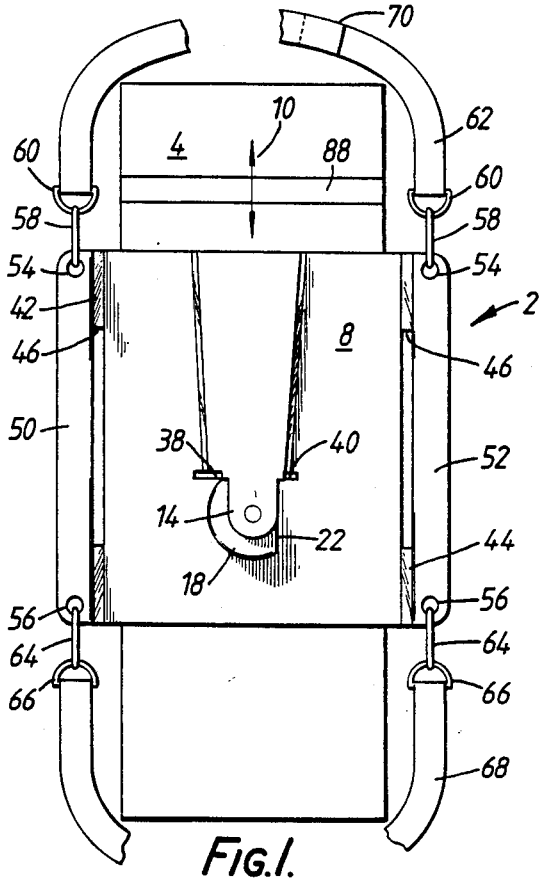
FIG. 1 is a plan view from the rear of an attachment device.

Referring to the drawings, there is shown an attachment device 2 for enabling an article in the form of a radio transceiver 4 to releaseably be secured on a person. The attachment device 2 comprises a first part 6 and a second part 8. The first and the second parts 6,8 respectively are engageable and disengageable by a sliding action when they are in the position shown in FIG. 1. The sliding action is backwards and forwards as illustrated by the arrow 10. When the first and the second parts 6,8 are relatively moved through 180° from their first relative position shown in FIG. 1 to their second relative position, they are not disengageable as will be described in detail hereinbelow. The first and the second parts 6,8 respectively have co-operating portions in the form of a pip 12 on a tongue 14 on the one hand and a depression 16 on a stud 18 on the other hand. These co-operating portions in the form of the pip 12 and the depression 16 enable the relative rotation of the first and second parts 6,8 to take place. They also prevent the first and the second parts 6,8 from disengaging when the first and the second parts are in their first relative position until such time as the first and the second parts 6,8 are subjected to a disengaging sliding action which exceeds a predetermined value.

Figure 5:
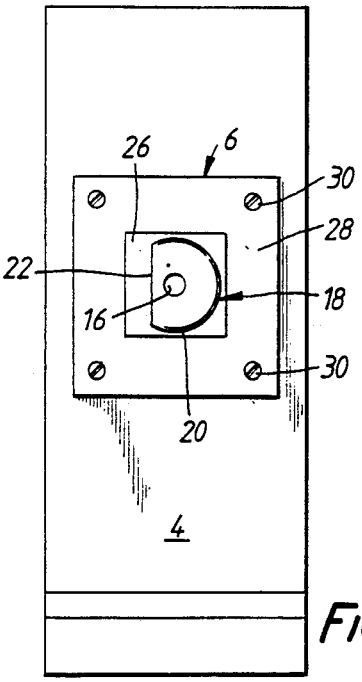
FIG. 5 shows a first part of the attachment device.
Figure 6:
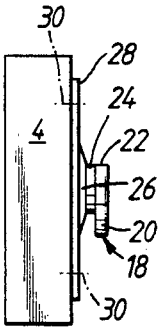
FIG. 6 is a top plan view of the first part shown in FIG. 5.

Referring to FIGS. 5 and 6, it will be seen that the stud 18 has a part-circular flange 20 which has a flat portion 22 along its periphery. The part-circular flange 20 is positioned on a shank 24 which upstands from a central raised portion 26 in a fixing plate 28. The raised portion 26 is formed by depressing the plate 28 upwardly as viewed in FIG. 5 and to the right as shown in FIG. 6. The plate 28 is provided with four holes for receiving screws 30. The screws 30 enable the plate 28 to be secured to the radio transceiver 4. The plate 28 is thus fixed to the radio transceiver 4 and the stud 18 is fixed to the plate 28 so that the stud 18 is effectively fixed in position to the radio transceiver 4.

Figure 7:
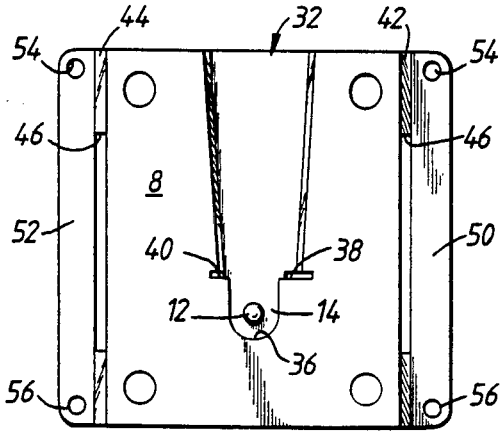
FIG. 7 is a front view of the second part of the attachment device.
Figure 8:
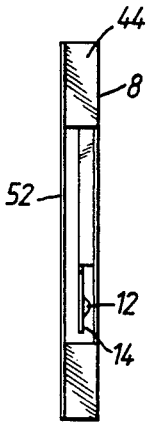
FIG. 8 is a side view showing the second part of FIG. 7 and looking from left to right in FIG. 7.

Referring to FIGS. 7 and 8, the second part 8 is shown as a plate member having a lead-in channel 32, the lead-in channel 32 being for receiving the stud 18 and guiding it towards the top end of the lead-in channel 32 as viewed in FIG. 7. As will be seen, the lead-in channel 32 terminates in the tongue 14 so that the lead-in channel 32 has a tongued portion constituted by the tongue 14. The lead-in channel 32 also terminates in a part-circular reception portion 36. The tongue 14 is spaced apart from the reception portion 36 as shown in FIG. 8 and, as the first and the second parts 6,8 are slid together, the reception portion 36 can slide underneath the part-circular flange 20 until it abuts the shank 24. The tongue 14 will then slide over the top of the part-circular flange 20 and the pip 12 will locate in the depression 16 on the stud 18.

When the pip 12 is in the depression 16, these two portions 12, 16 co-operate to enable the relative rotation of the first and the second parts 6, 8 to take place. They also prevent the first and the second parts 6,8 from disengaging when the first and the second parts 6, 8 are in their first relative position until such time as the first and second parts are subjected to a disengaging sliding action which exceed a predetermined value. More specifically, the tongue 14 is advantageously made of spring metal or other springing material so that the pip 12 is biased into the depression 16 by the natural resilience of the material from which the tongue 14 is made. This natural resilience can be of any predetermined and desired value and this value must be overcome in order to slide the first and the second parts 6,8 towards and away from each other, the pip 12 then sliding into and out of the depression 16 respectively.

Figure 2:
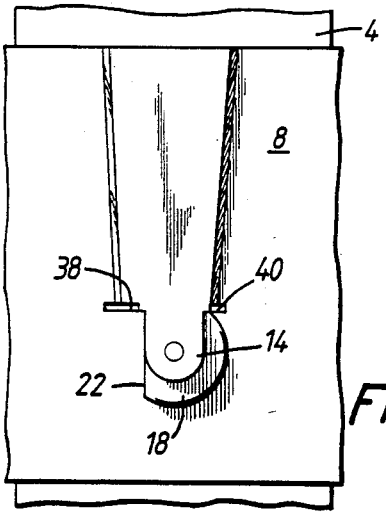
FIG. 2 shows in enlarged detail part of the attachment device of FIG. 1.

In the second relative position of the first and the second parts 6,8, it is not possible to slide the first and the second parts 6,8 away from each other. The reason for this is that the lead-in channel 32 connects to the part-circular reception portion 36 (which is underneath the tongue 14 shown in FIG. 2) by a large shoulder 38 and a small shoulder 40. In FIG. 2, the second part 8 is in the same position shown in FIG. 1 but the radio transceiver 4 has been rotated through 180°. Thus, the first part 6 (which includes the stud 18 and which is fixed to the radio transceiver 4)has been rotated through 180° from the first relative position illustrated in FIG. 1 to the second relative position illustrated in FIG. 5. In the second position, the part circular flange 20 is such that its circular portion engages the small shoulder 40 and so it is not possible to pull the radio transceiver 4 with its attached first part 6 away from the second part 8 by a sliding action. In contrast, in the position illustrated in FIG. 1, the large shoulder 38 is sufficiently large to enable the circular part of the part-circular flange 20 to clear the large shoulder 38 and thus to slide out of the lead-in channel 32. For ease of understanding, it is mentioned that the lead-in channel 32 is shown as a raised tunnel portion in FIGS. 1 and 2 and it is in fact formed by depressing this part of the illustrated plate out of the plane of the remainder of the plate.

Figure 3:
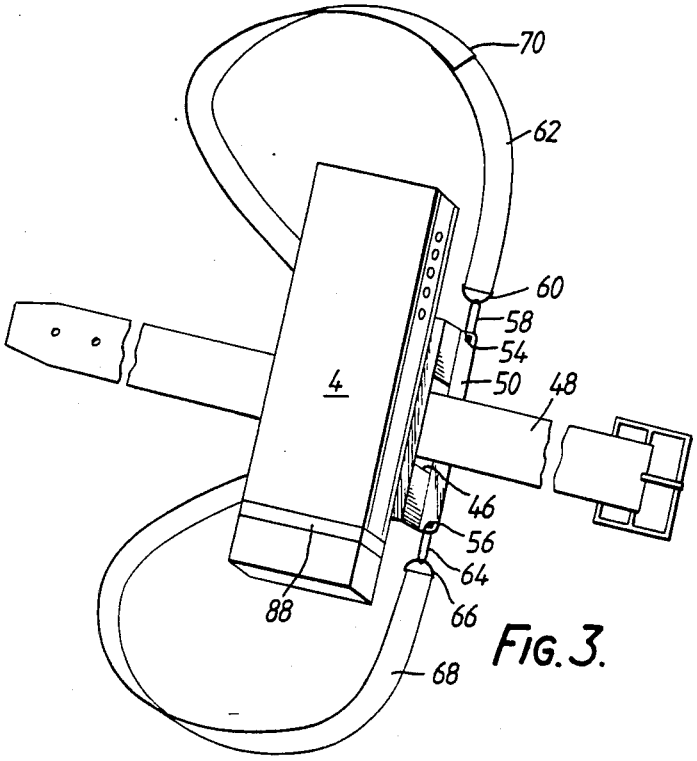
FIG. 3 is a front perspective view of the attachment device shown in FIG. 1.

Referring back to FIGS. 7 and 8, it will be seen that the second part 8 which is in the form of the plate has a pair of side walls 42, 44 and these side walls 42,44 are each provided with a slot 46. A belt 48 (see FIG. 3) passes through the slots 46. The belt 48 enables the radio transceiver to be worn around the person's waist.

The side walls 42,44 extend respectively into flanges 50,52 and these flanges 50,52 are each provided with a pair of holes 54, 56. The uppermost pair of holes 54 as viewed in FIG. 7 may receive metal clips 58, which connect also to D-rings 60. The D-rings 60 are themselves connected to a strap 62. Similarly, the holes 56 may receive clips 64, the clips 64 connecting to D-rings 66. The D-rings 66 are themselves connected to a strap 68. The strap 62 and/or the strap 68 may be used to support the radio transceiver 4 at various parts of a person's body, for example over the shoulders or around the neck. The straps 62,68 can be used with or without the belt 48.

Figure 4:
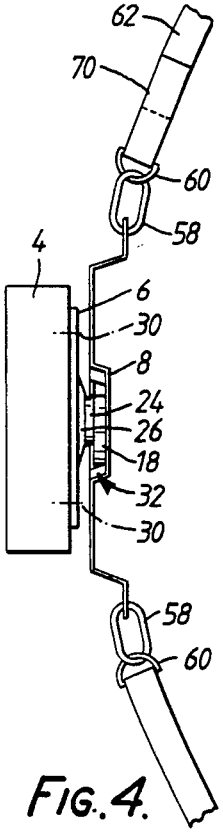
FIG. 4 is a top plan view of the attachment device shown in FIG. 1.

As illustrated somewhat schematically in FIG. 4, when the upper strap 62 is used it is advantageously provided with a break point 70 formed by cutting the strap 62 and joining it with Velcro (Registered Trade Mark) material. Thus, in the event that the radio transceiver 4 should be worn by the police or other security personnel and an assailant grabs the radio transceiver 4 or the strap 62, then the strap 62 around the person's neck will come apart at the break point 70 due to the Velcro material tearing apart and the assailant will not be able to use the webbing 62 to gain an unfair advantage over the police or other security personnel, for example using the webbing 62 to effect a tying action or a strangulation action. A similar break point 70 will usually not be provided in the lower strap 68 because the strap 68 is usually best left more permanently secured around the person's body. The metal clips 58, 64 are advantageously arranged to pull apart if extreme use is used so that a person wearing the attachment device 2 can free himself or herself in the event that the attachment device 2 should become entagled in machinery.

Figure 9:
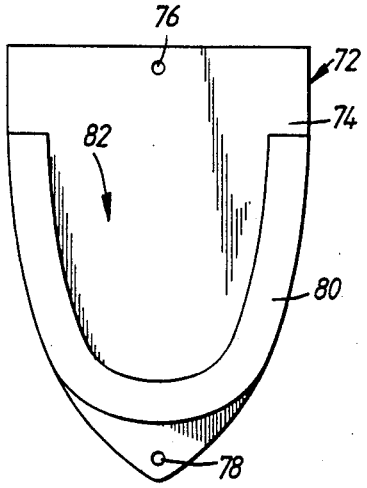
FIG. 9 is a plan view of a holder device for use with the first part of the attachment device when it is separated from the second part of the attachment device.
Figure 10:
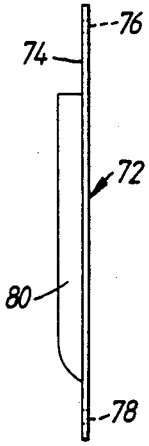
FIG. 10 is a side view of the holder device shown in FIG. 9.

Referring now to FIGS. 9 and 10, there is illustrated a known holder device 72 having a flat back portion 74 which is provided with a pair of apertures 76,78 for enabling the holder device 72 to be secured to a wall, a car dash board or other position. A raised portion 80 forms a cup light receptacle position 82 for receiving the shank 24 of the stud 18. Thus the first part 6, although newly designed to form of part of the attachment device 2 of the present invention is such that it will also fit to an existing holder device 72. Thus, the attachment device 2 is not only usable with its own custom made second part 8 but is also usable with existing holder devices 72. This greatly increases the universality of use of the attachment device 2. For example, the positive engagement and disengagement offered by the attachment device 2 can be used to very good advantage, especially giving the positive advantage which prevents equipment such for example as radio transceivers 4 becoming lost during riot control and similar disturbances, for example by police. The relative rotation of the first and second part 6,8 enables the radio transceiver 4 to pivot or swivel to an acceptable position as the person wearing the attachment device 2 sit down. This avoids the often hitherto need to completely remove the radio transceiver 4 and perhaps place it in a holder device 72 of the type illustrated in FIGS. 9 and 10 and from which the radio transceiver 4 can easily fall out because there is no positive means for stopping unwanted disengagement. Worse still, if the radio transceiver 4 is merely placed on a car dash board, it will be appreciated that violent cornering, for example as in a vehicle chase, merely results in the radio transceiver 4 falling to the floor, with consequent distraction for the driver, possible damage to the radio transceiver 4, and possible loss of contact of the driver with base.

Another advantage of the attachment device 2 is that the first and the second parts 6,8 are separated by actually gripping the radio transceiver 4 to which the first part 6 is permanently and fixedly secured. The radio transceiver 4 provides a large object to grip and the second part 8 will normally be secured about the person of the wearer so that this is also relatively fixed in position. Thus, the first and the second parts 6,8 can easily be separated by persons having cold and numb hands for example, or gloved hands. Fiddley and complicated manoeuvers are not required and the first and the second parts can easily and quickly be separated.

It is to be appreciated that the embodiment of the invention described above has been given by way of example only and that modifications may be effected. Thus, for example, the belts 62,68 can be reconnected from the position shown in FIG. 3 to the position shown in FIG. 1. Also, the holes 54, 56 can be replaced by holes 84,86 as shown in FIG. 7, in which case the flanges 50,52 can be made narrower than is shown in the drawings. Further, instead of a radio transceiver 4, the attachment device 2 can be used for attaching any other article such for example as a hammer, a screw driver, an axe, a torch or a key ring to a person in a safe and comfortable manner and also in a manner in which the article can easily be clipped and unclipped. Further, preferably, the first part 6 will usually be fixed relative to the radio transceiver or other article so that the article will swing by gravity to the second relative position in which disengagement is prevented. The radio transceiver 4 shown in the drawings is provided with a black leather surface except for a metal band 88 but this design can obviously be varied as may be desired.

I claim:

1. An attachment device for enabling an article to releasably be secured on a person, which attachment device comprises a stud, a plate member and co-operating portions of said stud and said plate member, said stud including a part circular flange which has a flat portion along its periphery, said plate member including, (i) a lead-in channel which extends from an edge of said plate member towards an opposite edge of said plate member;

(ii) a part-circular reception portion which extends from said channel;

(iii) a tongued portion which extends from said reception portion in the direction of said reception portion but spaced apart from said reception portion;

(iv) a first pair of shoulders which connect said reception portion to said channel and which are such that one shoulder is shorter than the other shoulder;

(v) a second pair of shoulders which connects said tongued portion to said channel and which are such that one shoulder is shorter than the other shoulder, said first and said second pairs of shoulders causing said channel to be longitudinally non-symmetrical so that said stud is only able to slide along said channel from said edge of said plate member when said flat portion of said flange is adjacent that shoulder in each said pair of shoulders that is said shortest shoulder, and said attachment device being such that said stud and said plate member are engageable and dis-engageable by a sliding action along said channel when said stud and said plate member are in a first relative position, said attachment device being such that said stud and said plate member are not dis-engageable when said stud and said plate member have been rotated to a second relative position, and said co-operating portions on said stud and said plate member being such as to permit said rotation and also to prevent said stud and said plate member from dis-engaging when they are in said first relative position until said stud and said plate member are subjected to a dis-engaging sliding action which exceeds a predetermined value.

2. An attachment device according to claim 1 in which said co-operating portions are a pin on said tongued portion and a complementary depression on said stud.

3. An attachment device according to claim 2 in which said plate member is a metal plate member, in which said tongued portion is cut and pressed out of said plate member to leave behind said reception portion, and in which said channel is pressed out of said plate member.

4. An attachment device according to claim 3 in which said stud projects from a fixing plate, and in which said stud is fixed in position with respect to said fixing plate.

5. An attachment device according to claim 4 in which said stud and said fixing plate are rotatable through 180° to go from said first relative position to said second relative position.

6. An attachment device according to claim 1 in which said plate includes a pair of side walls, and in which said side walls are each provided with a slot, said slots being for receiving a belt.

7. An attachment device according to claim 6 in which said plate member has four holes which are each for receiving a clip, said plate member being four sided and there being one said hole in each corner of said plate member.

* * * * *